US011286750B2

(12) United States Patent
Morrison et al.

(10) Patent No.: US 11,286,750 B2
(45) Date of Patent: Mar. 29, 2022

(54) STOP COLLAR ASSEMBLY

(71) Applicant: Weatherford Technology Holdings, LLC, Houston, TX (US)

(72) Inventors: Jeffery Morrison, Missouri City, TX (US); Jobby T. Jacob, Sugar Land, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 16 days.

(21) Appl. No.: 16/836,578

(22) Filed: Mar. 31, 2020

(65) Prior Publication Data

US 2021/0301627 A1 Sep. 30, 2021

(51) Int. Cl.
*E21B 41/00* (2006.01)
*E21B 17/10* (2006.01)

(52) U.S. Cl.
CPC ..... *E21B 41/00* (2013.01); *E21B 17/1078* (2013.01)

(58) Field of Classification Search
CPC .. E21B 17/1028; E21B 17/1078; E21B 17/10; E21B 37/02; E21B 17/1021; E21B 17/16; E21B 41/00
See application file for complete search history.

(56) References Cited

U.S. PATENT DOCUMENTS 327,793 A 10/1885 Hall
1,822,887 A 9/1931 Hagstedt
2,824,613 A * 2/1958 Baker ..... E21B 17/1028 166/241.7
2,855,052 A 10/1958 Wright et al.
3,040,405 A 6/1962 Solum
3,887,990 A 6/1975 Wilson
3,916,998 A * 11/1975 Bass, Jr. ..... E21B 17/1078 166/301
4,000,549 A * 1/1977 Brumley ..... E21B 17/1078 175/325.5
4,105,262 A * 8/1978 Richey ..... E21B 17/1078 175/325.2
4,630,690 A 12/1986 Beasley et al.
(Continued)

FOREIGN PATENT DOCUMENTS

EP 0257943 A2 3/1988
EP 3633136 A1 * 4/2020 ..... E21B 17/04

OTHER PUBLICATIONS

International Search Report and Written Opinion dated May 14, 2021 for Application No. PCT/US2021/022185.

*Primary Examiner* — Daniel P Stephenson
(74) *Attorney, Agent, or Firm* — Patterson + Sheridan, LLP

(57) ABSTRACT

A stop collar assembly includes a collar having inner and outer surfaces. The inner surface includes a taper. The outer surface includes a slope such that an outer diameter at a start of the slope is greater than an outer diameter at an end of the slope. The stop collar assembly further includes a slip having a bottom end and a taper adjoining the bottom end. The slip taper is configured to contact the collar taper. When the collar taper is in contact with the slip taper, a distance from a central radial axis of the collar to the start of the slope is less than a distance from the central radial axis to the slip bottom end, and the distance from the central radial axis to the slip bottom end is less than a distance from the central radial axis to the end of the slope.

20 Claims, 8 Drawing Sheets

(56) References Cited

U.S. PATENT DOCUMENTS

| | | | | |
|---|---|---|---|---|
| 4,776,410 | A * | 10/1988 | Perkin | E21B 10/22 175/325.4 |
| 5,706,894 | A | 1/1998 | Hawkins, III | |
| 5,860,760 | A | 1/1999 | Kirk | |
| 6,227,297 | B1 * | 5/2001 | Milam | B08B 9/023 15/104.04 |
| 6,453,998 | B1 * | 9/2002 | Reeve | E21B 17/1014 166/241.1 |
| 6,957,704 | B2 * | 10/2005 | Rogers | E21B 17/1028 166/378 |
| 7,942,199 | B2 | 5/2011 | Angman | |
| 8,074,712 | B2 | 12/2011 | Olsen et al. | |
| 8,641,113 | B1 * | 2/2014 | Russell | E21B 31/00 294/86.1 |
| 8,763,690 | B2 | 7/2014 | Buytaert et al. | |
| 8,832,906 | B2 | 9/2014 | Buytaert et al. | |
| 8,851,168 | B2 | 10/2014 | Buytaert et al. | |
| 8,863,834 | B2 | 10/2014 | Buytaert et al. | |
| 9,127,519 | B2 * | 9/2015 | Jordan | E21B 17/1028 |
| 9,322,228 | B2 | 4/2016 | Davila et al. | |
| 9,816,344 | B2 * | 11/2017 | Roselier | E21B 17/07 |
| 9,909,372 | B2 * | 3/2018 | Jewett | E21B 17/1078 |
| 9,982,494 | B2 | 5/2018 | Steine | |
| 2004/0226714 | A1 | 11/2004 | Rogers | |
| 2012/0018998 | A1 | 1/2012 | Langlais et al. | |
| 2013/0160993 | A1 | 6/2013 | Davila et al. | |
| 2015/0275588 | A1 * | 10/2015 | Trowbridge | E21B 17/1078 166/241.6 |
| 2018/0148982 | A1 | 5/2018 | Rodriguez et al. | |
| 2020/0109607 | A1 * | 4/2020 | Mackay | E21B 19/16 |

* cited by examiner

STOP COLLAR ASSEMBLY

BACKGROUND

Field

Embodiments of the present disclosure generally relate to a stop collar assembly for use on oilfield tubulars.

Description of the Related Art

A wellbore is formed to access hydrocarbon bearing formations, such as crude oil and/or natural gas, by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a casing string is lowered into the wellbore. An annulus is formed between the string of casing and the wellbore. The casing string is cemented into the wellbore by circulating cement slurry into the annulus. The combination of cement and casing strengthens the wellbore and facilitates the isolation of certain formations behind the casing for the production of hydrocarbons.

Typically, centralizers are mounted on the casing string in order to deter the outer surface of the casing string tubulars from resting against the borehole wall, and hence provide a "stand-off" between the casing string and the borehole wall. Thus, the use of centralizers helps to promote the establishment of a full 360° sheath of cement around the casing string. Additionally, the stand-off provided by centralizers serves to minimize the frictional contact between the casing string and borehole wall, and therefore facilitates the insertion of the casing string into the borehole, especially in long horizontal and extended reach boreholes. Multiple centralizers are spaced apart along the casing string to provide centralization of the casing string at multiple points throughout the wellbore. In order to achieve consistency of the stand-off of a casing string along the length of the casing string, it is usually important to install centralizers at specific locations along the casing string. These locations may be predetermined using computer software or other calculations that simulate the insertion of the casing string into—and cementation of the casing string within—the borehole. Typically, it is important for the centralizers to be maintained at or near to their identified specific locations on the casing string in order for the centralizers to achieve the desired results of casing stand-off and the establishment of a 360° cement sheath around the casing.

Each centralizer has blades extending out from the casing wall and contacting the wellbore, thereby holding the casing string off of direct contact with the wellbore wall, and substantially centralizing the casing therein. To accomplish that goal, the centralizer blades typically form a total centralizer diameter roughly the diameter of the wellbore in which the casing string is run. One type of centralizer has a solid central tubular body having a plurality of solid blades integral with the central body, the blades extending out to the desired diameter. Another type is a bow spring centralizer having a pair of spaced-apart bands locked into place on the casing, and a number of outwardly bowed, resilient bow spring blades connecting the two bands and spaced around the circumference of the bands. The bow spring centralizers are capable of at least partially collapsing as the casing string passes through any restricted diameter location, such as section of borehole or a piece of equipment having an inner diameter smaller than the at-rest bow spring diameter, and then springing back out after passage through the restricted diameter location.

Stop collars are mounted on the casing string to restrict axial movement of centralizers (or other casing-mounted accessories, such as scratchers) on the casing string. A stop collar mounted above a centralizer on the casing string restricts upward movement of the centralizer while lowering the casing string into the wellbore. Likewise, a stop collar mounted below a centralizer on the casing string restricts downward movement of the centralizer while lifting the casing string in the wellbore. The lengths of casing strings in boreholes typically range from several hundred to several thousand feet (also several hundred to several thousand metres), and thus it is common to deploy many centralizers on a typical casing string. Hence, many stop collars may be used on a typical casing string.

Because stop collars serve to limit the axial movement of centralizers or other casing-mounted accessories on a casing string, the stop collars must be securely anchored to the casing. A typical scenario in use involves a casing string being manipulated in a borehole (such as during insertion of the casing string into the borehole) and a centralizer becoming axially stuck in place due to an obstruction in the borehole. Here, a stop collar would be required to move with the casing string, bear against the centralizer, transmit an axial load from the casing string onto the centralizer, and thus promote the movement of the centralizer past the obstruction. Therefore, stop collars must be securely attached to the casing string such that the stop collars may withstand axially-applied loads without moving with respect to the casing string. Users of stop collars may specify a minimum load that a stop collar should be able to withstand when it is installed on a casing string. Such load-bearing capacity may be 50,000 lbs. or greater, even up to 100,000 lbs. Thus, there is requirement for each and every stop collar to be designed and installed so as to be reliably and consistently secured to a casing tubular.

The consistent reliable attachment of stop collars to oilfield casing tubulars is hampered by the industry-accepted variation in oilfield casing tubular dimensions. The American Petroleum Institute standard for oilfield tubulars, API 5CT, specifies that for any tubular whose nominal outer diameter is 4½" or greater, the minimum acceptable actual outer diameter is 0.5% less than the nominal value, and the maximum acceptable actual outer diameter is 1% greater than the nominal value. Although these tolerance limits appear to be quite narrow, they have a significant effect on the design and sizing of tubular-mounted accessories, such as centralizers and stop collars, particularly for those designed for medium and large diameter tubulars. For example, an oilfield casing tubular with a nominal outer diameter of 16" could have a true outer diameter ranging from 15.92" to 16.16", a variance of 0.24". Naturally, a tubular of a larger nominal diameter could have a true outer diameter within a larger range of sizes. A stop collar designed for such a size of tubular preferably would have an attachment mechanism that provides a consistent, reliable securement to a tubular that not only is able to withstand an axial load of up to 100,000 lbs. without slipping on the tubular, but also does so while being able to accommodate the industry-accepted size variation of the tubular.

Some stop collars have slip-type mechanisms for their securement to a tubular. Such mechanisms generally rely upon the relative movement between two members interfacing at ramped surfaces in order to effect the necessary gripping action of a slip member onto a tubular.

Some example embodiments of slip mechanisms comprise a stop collar assembly having a slip mounted inside a collar, where a mechanical interface between the slip and the collar includes cooperating ramps, and rely upon the slip being held axially stationary on a tubular by friction before axial movement of the collar causes the necessary interaction with the slip to effect a grip on the tubular. Such mechanisms risk the occurrence of axial slippage of the collar during use, resulting in a loosening of the grip on the tubular, thereby compromising the capability of the stop collar assembly to withstand the required axial loads.

Other example slip mechanisms comprise the use of a slip wedge element that is inserted into the annular gap between a collar and the tubular. Again, a ramped surface on the slip wedge element cooperates with a ramped surface on the underside of the collar to effect the necessary gripping action. Such devices commonly use relatively shallow ramp angles, such as 10°, in order to effect a sizeable contact area between the slip wedge element and the tubular to achieve the required capability to withstand high axial loads. These mechanisms suffer disadvantages when applied to stop collar assemblies configured for medium and large diameter tubulars because of the variation in actual tubular diameters for which such devices must be designed. Referring back to the example nominal 16" tubular size, to accommodate the spread of actual tubular diameters to which a stop collar assembly must be consistently and reliably attached, a 10° slip ramp mechanism must allow for an extra 0.68" of axial travel in addition to the—in some cases—several inches of travel needed to set the slip. Thus, such assemblies tend to be quite long, which has detrimental impacts on manufacturing costs, transportation costs, etc.

Conventional stop collars may catch and interfere with a wall of the wellbore in restricted-diameter locations. Conventional stop collars may also require fasteners to attach to a casing string. These fasteners may comprise screws and/or sets of grippers that are installed manually. Manual installation of such fasteners may be time-consuming and also subject to variations in the consistency of the installation from stop collar to stop collar. Conventional stop collars may also require measurement of each section of the casing string and custom manufacturing to ensure a suitable fit between the stop collar and the casing string. Because stop collars are mounted to the exterior of a casing string, the stop collars add to the overall outer diameter of the casing string.

A further constraint on stop collar design is presented by the increasing industry adoption of so-called "close-tolerance" casing schemes in well design. This involves a situation in which a casing being inserted into a wellbore plus any devices attached to the outside of that casing must be dimensioned to fit within a pre-installed casing whose inner diameter is only slightly larger than the outer diameter of the casing being inserted. One example of a close tolerance casing design involves 11.75" casing being installed through a 14" nominal outer diameter casing string that has an internal drift diameter of 12.25". Ordinarily, stop collars may be designed such that the requirements of high axial load bearing and accommodation of tubular size variations be met by using components whose dimensions are incompatible with the sizing requirements of close-tolerance casing schemes.

Thus, there is a need for stop collars that have a low profile to pass through restricted diameter locations in the wellbore, can accommodate variations of casing tubular outer diameter, and achieve a consistently secure, reliable attachment to casing tubulars capable of withstanding high axial loads without slipping on the casing tubulars.

SUMMARY

In one embodiment, a stop collar assembly for mounting around a tubular includes a collar having a collar inner surface, a collar outer surface, a collar top end tip, a collar bottom end tip, a central radial axis, and a longitudinal axis. The collar inner surface includes a collar first taper adjoining the collar top end tip. The collar outer surface includes a first slope defining a first slope angle with respect to the longitudinal axis. A collar outer diameter at a start of the first slope is greater than a collar outer diameter at an end of the first slope. The stop collar assembly further includes a first slip having a first slip bottom end and a first slip outer surface. The first slip outer surface includes a first slip taper adjoining the first slip bottom end. The first slip taper is configured to contact the collar first taper. When the collar first taper is in contact with the first slip taper, a distance from the central radial axis to the start of the first slope is less than a distance from the central radial axis to the first slip bottom end, and the distance from the central radial axis to the first slip bottom end is less than a distance from the central radial axis to the end of the first slope.

In another embodiment, a stop collar assembly for mounting around a tubular includes a collar having a collar inner surface, a collar outer surface, a collar top end portion, a collar bottom end portion, and a longitudinal axis. The collar top end portion includes a collar first taper adjoining the collar inner surface and adjoining a collar top end tip. The collar bottom end portion includes a collar second taper adjoining the collar inner surface and adjoining a collar bottom end tip. The stop collar assembly further includes a first slip and a second slip. The first slip has a first slip length measured parallel to the longitudinal axis, a first slip inner surface, and a first slip taper. The second slip has a second slip length measured parallel to the longitudinal axis, a second slip inner surface, and a second slip taper. When the stop collar assembly is secured in position around the tubular, at least a portion of the first slip inner surface is in gripping contact with the tubular. When the stop collar assembly is secured in position around the tubular, at least a portion of the second slip inner surface is in gripping contact with the tubular. When the stop collar assembly is secured in position around the tubular, at least a portion of the first slip taper abuts at least a portion of the collar first taper. When the stop collar assembly is secured in position around the tubular, at least a portion of the second slip taper abuts at least a portion of the collar second taper. When the stop collar assembly is secured in position around the tubular, a majority of the first slip length protrudes from the collar top end portion, and a majority of the second slip length protrudes from the collar bottom end portion.

In another embodiment, a stop collar assembly for mounting around a tubular includes a collar having a collar inner surface, a collar outer surface, a collar top end, a collar bottom end, and a longitudinal axis. The stop collar assembly further includes a first slip configured to be disposed at least partially within the collar and to be radially compressed by the collar. The first slip has a first slip inner surface, a first slip outer surface, a first slip top end, and a first slip bottom end. The first slip outer surface includes a first slip taper defined at an angle A with respect to the longitudinal axis and positioned proximate to the first slip bottom end. The collar inner surface includes a collar first taper defined at an angle B with respect to the longitudinal axis and adjoining the collar top end. The first slip taper is configured to interact with the collar first taper, and the angles A and B are not equal.

In another embodiment, a stop collar assembly for mounting around a tubular includes a collar having a collar inner surface, a collar outer surface, a collar top end portion, a collar bottom end portion, a central radial axis, and a longitudinal axis. The collar top end portion includes a collar first taper adjoining the collar inner surface at a collar first taper start and adjoining a collar top end tip at a collar first taper end. The stop collar assembly further includes a first slip having a first slip bottom end adjoining a first slip taper, the first slip taper adjoining a first slip outer surface at a first slip taper start. When the stop collar assembly is secured in position around the tubular, at least a portion of the first slip inner surface is in gripping contact with the tubular. When the stop collar assembly is secured in position around the tubular, at least a portion of the first slip taper abuts at least a portion of the collar first taper. When the stop collar assembly is secured in position around the tubular, a distance from the central radial axis to the collar first taper start is greater than a distance from the central radial axis to the first slip bottom end. When the stop collar assembly is secured in position around the tubular, a distance from the central radial axis to the collar first taper end is greater than a distance from the central radial axis to the collar first taper start. When the stop collar assembly is secured in position around the tubular, a distance from the central radial axis to the first slip taper start is greater than a distance from the central radial axis to the collar top end tip.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of the scope of the disclosure, which may pertain to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure relates to a stop collar assembly for mounting around, and securing to, an oilfield tubular.

Figure 1:
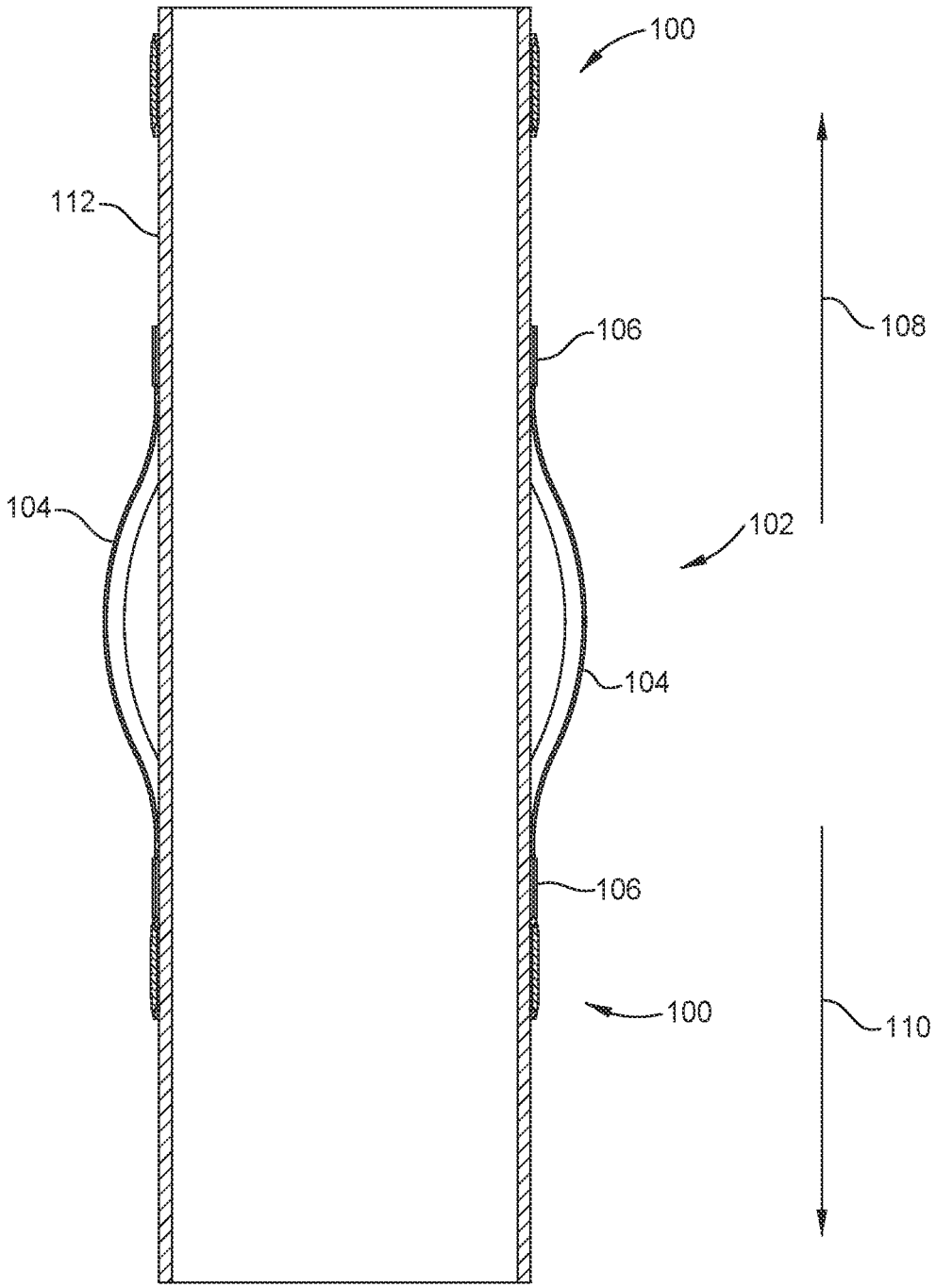
FIG. 1 shows an arrangement of a centralizer and stop collars assembled onto a tubular.

FIG. 1 is a longitudinal cross section showing two stop collar assemblies 100 of the present disclosure and a centralizer 102 that have been mounted around a tubular 112. While the centralizer 102 may be any type of centralizer known to those skilled in the art, the illustrated centralizer 102 has outwardly projecting bows 104 that terminate at end bands 106. The centralizer 102 is mounted between the stop collar assemblies, and thus axial movement of the centralizer 102 along the tubular 112 is restricted in both longitudinal directions 108, 110 by interaction between an end band 106 and the adjacent stop collar assembly 100. Alternative arrangements are also contemplated, such as the provision of only a single stop collar assembly 100 next to the centralizer 102 so as to limit axial movement of the centralizer 102 in a single longitudinal direction 108 or 110. Another alternative arrangement involves the location of a single stop collar assembly 100 on the tubular 112 being between the centralizer 102 end bands 106, whereby axial movement of the centralizer 102 along the tubular 112 is restricted in both longitudinal directions 108, 110 by interaction between an end band 106 and the single stop collar assembly 100.

Figure 2A:
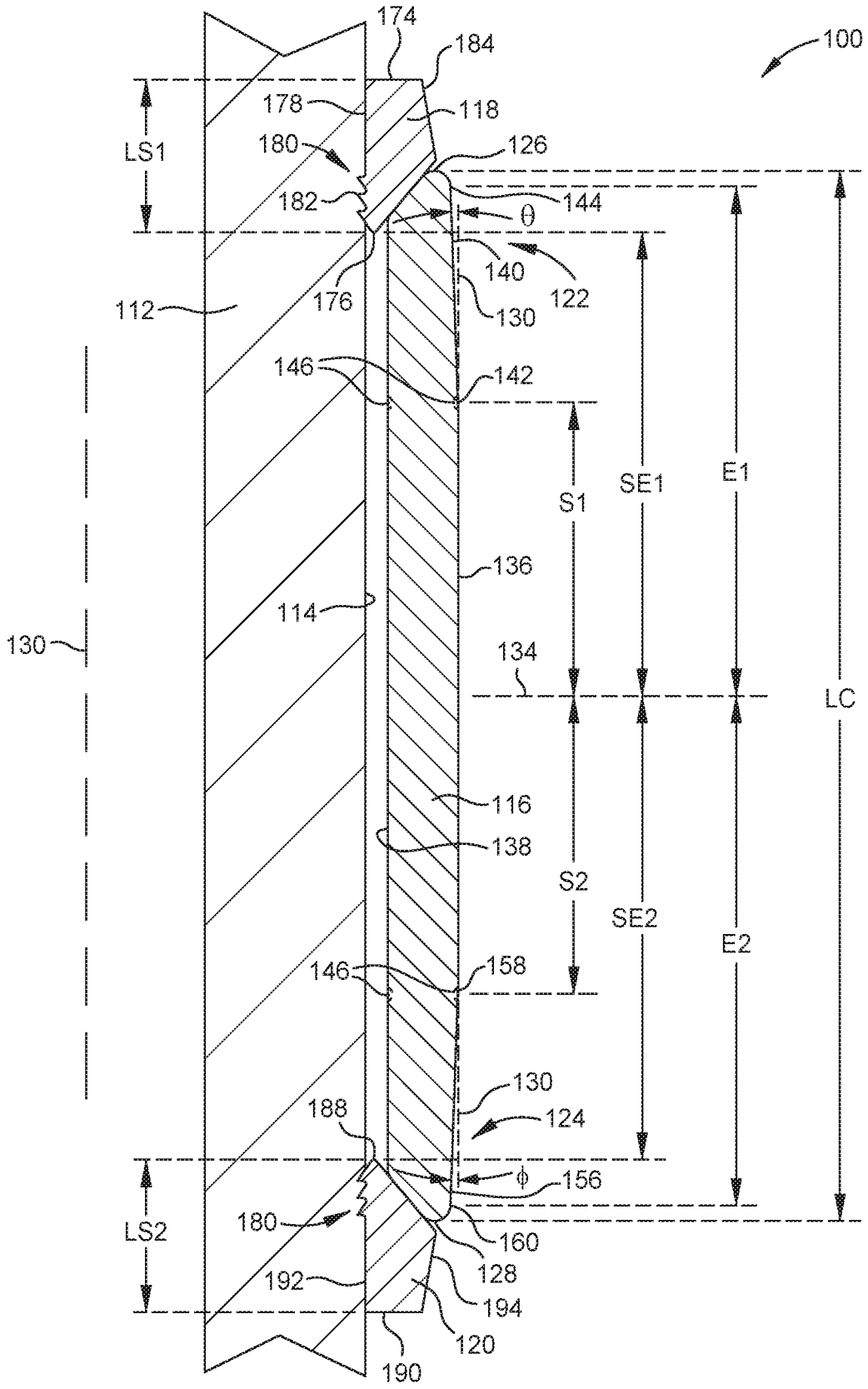
FIGS. 2A to 2C present longitudinal cross-sections showing a stop collar assembly of the present disclosure mounted onto a tubular.
Figure 2B:
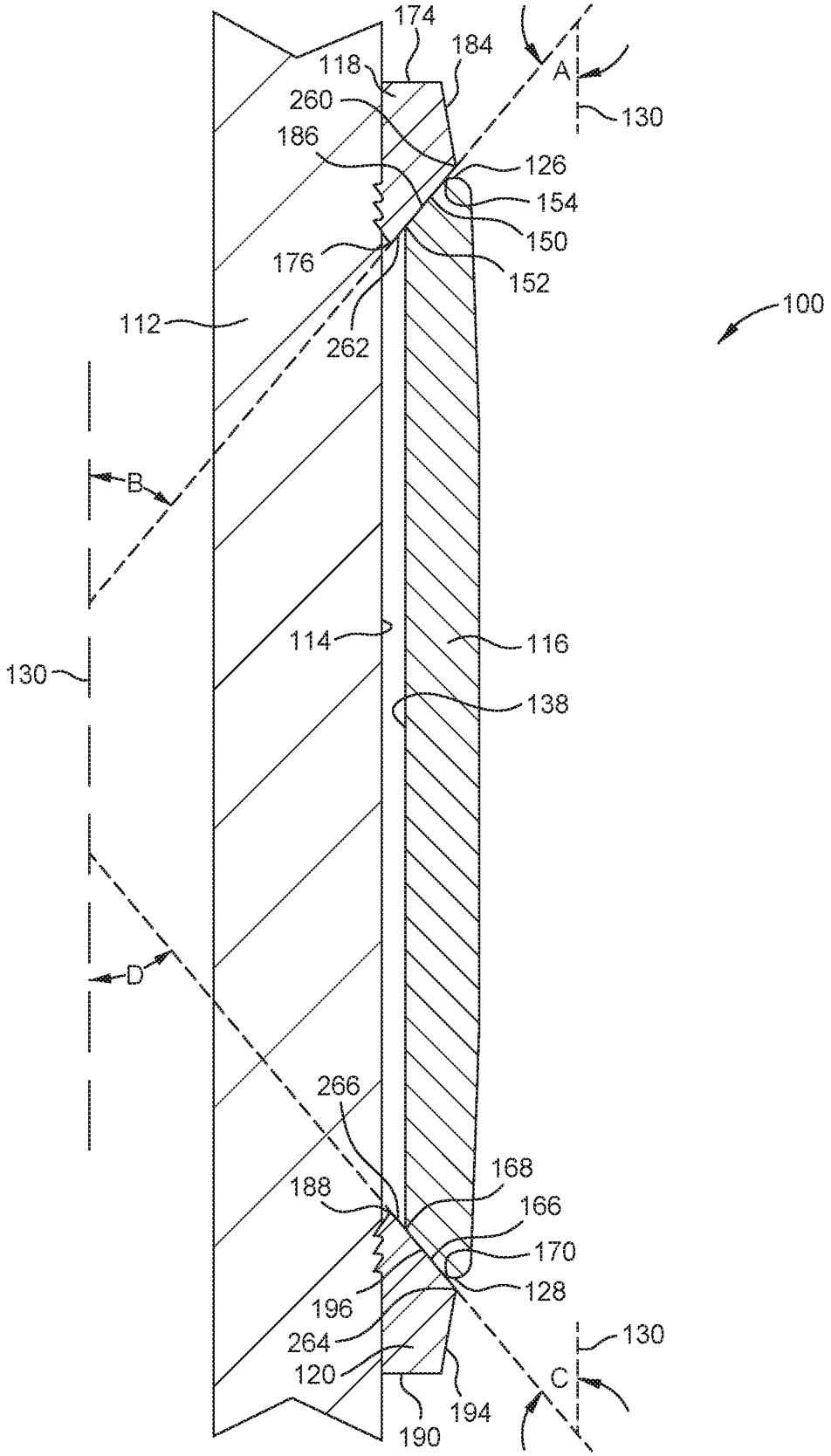
Figure 2C:
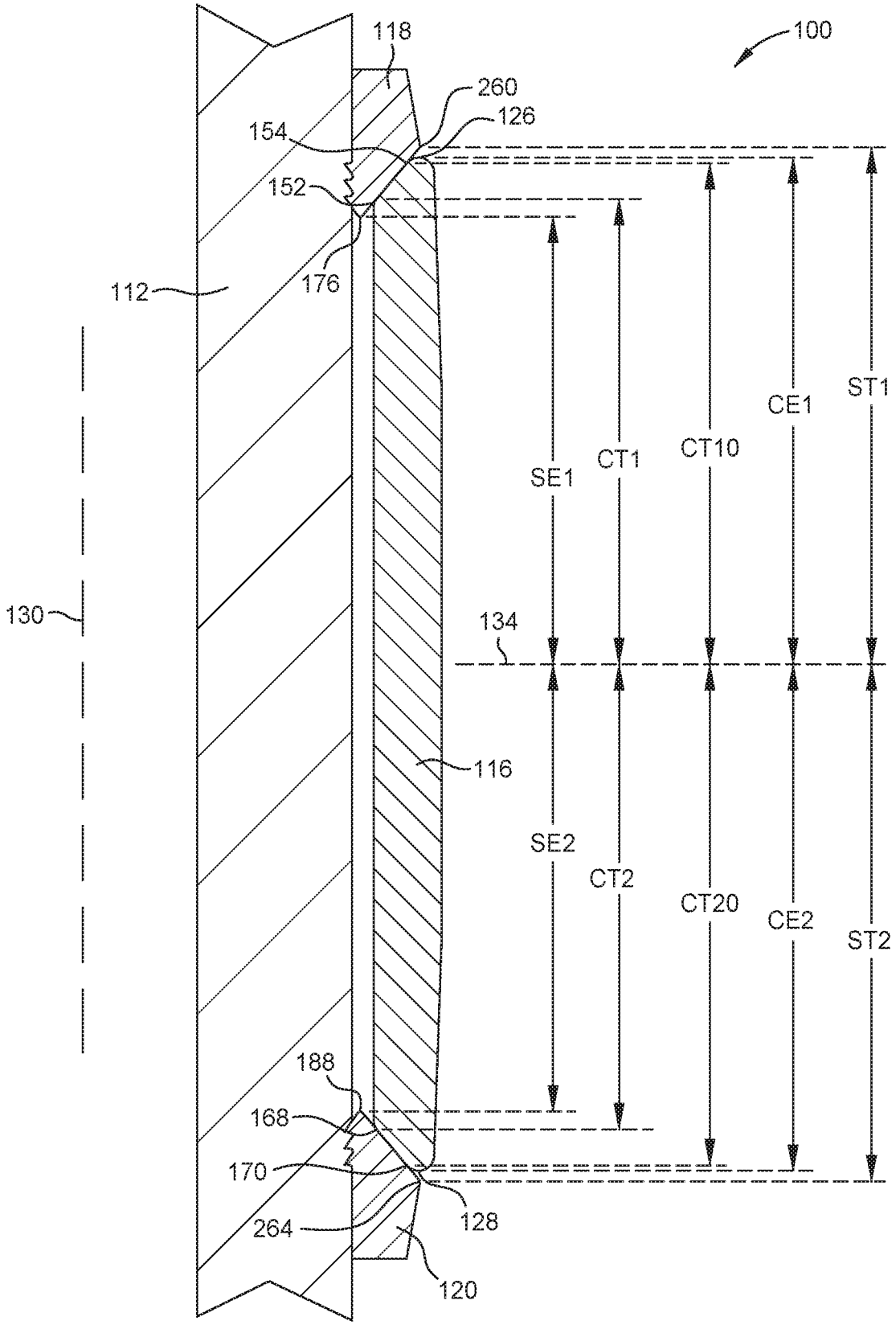

FIGS. 2A to 2C present longitudinal cross section views of a stop collar assembly 100 according to a first embodiment that is shown mounted on a tubular 112. These figures present the same view of the same assembly; the labelling of items and dimensions is allocated across the figures for ease of illustration. The views present one half of a longitudinal cross section, it being understood that the unseen half would be a mirror image of the half that is presented. The tubular 112 may be sized to be part of a close-tolerance casing scheme. The stop collar assembly 100 may comprise a collar 116, a first slip 118, and a second slip 120. The collar 116 may have a collar top end portion 122 engaged with the first slip 118, and a collar bottom end portion 124 engaged with the second slip 120. The collar 116, the first slip 118, and the second slip 120 may be annular in shape. The collar 116 may have a collar top end tip 126 at an end of the collar top end portion 122, a collar bottom end tip 128 at an end of the collar bottom end portion 124, and a collar length LC defined as the distance between the collar top end tip 126 and the collar bottom end tip 128. The collar 116 may be substantially cylindrical, having a longitudinal axis 130 that, when the stop collar assembly 100 is mounted on a tubular 112, is aligned generally with a longitudinal axis of the tubular 112. The collar further has a central radial axis 134 defined perpendicularly to the longitudinal axis 130 at the mid-point of the collar length LC.

The collar 116 may have a collar outer surface 136 and a collar inner surface 138. A collar outer diameter may be measured from any location on the collar outer surface 136 (or at any outward-facing location) parallel to the central radial axis 134. Although the collar 116 may be substantially cylindrical, the collar outer diameter may differ when measured at different locations along the collar length LC and at different locations around the outer circumference of the collar 116. Similarly, a collar inner diameter may be measured from any location on the collar inner surface 138 (or at any inward-facing location) parallel to the central radial axis 134. Although the collar 116 is substantially cylindrical, the collar inner diameter may differ when measured at different locations along the length and at different locations around the inner circumference of the collar 116.

The collar top end portion 122 may include a first slope 140 of the collar outer surface 136. As shown, the first slope 140 may be defined by an angle θ with respect to the longitudinal axis 130 extending from a start point 142 to an end point 144 along a length of the collar outer surface 136. The magnitude of angle θ may 60° or less, 50° or less, 40° or less, 30° or less, 20° or less, 10° or less, or between 0° and 5°. Alternatively, the first slope 140 may be defined by a sequence of two or more angles with respect to the longitudinal axis 130 extending from the start point 142 to the end point 144 along a length of the collar outer surface 136. As a further alternative, or as an additional aspect, the first slope 140 may be defined by a curvature of the collar outer surface 136 with respect to the longitudinal axis 130 extending from the start point 142 to the end point 144 along a length of the collar outer surface 136. The start point 142 of the first slope 140 may be located at a distance S1 from the central radial axis 134, and the end point 144 of the first slope 140 may be located at a distance E1 from the central radial axis 134, such that distance E1 is greater than distance S1. Additionally, a collar outer diameter at the start point 142 of the first slope 140 may be greater than a collar outer diameter at the end point 144 of the first slope 140. In some embodiments, the collar outer surface 136 may include one or more circumferential groove(s) 146 at and/or proximate to the start point 142 of the first slope 140. The end point 144 of the first slope 140 may be proximate to the collar top end tip 126, and/or the end point 144 of the first slope 140 may adjoin or may be coincident with the collar top end tip 126. The collar top end tip 126 may be angled with respect to the longitudinal axis 130. Alternatively, or additionally, the collar top end tip 126 may be at least partially rounded. Furthermore, the collar top end tip 126 may define at least in part a rounded profile such that the first slope 140 adjoins the collar top end tip 126 tangentially to the rounded profile at the end point 144 of the first slope 140. In some embodiments, the collar top end tip 126 may have a surface adjoining a rounded profile, which surface may be substantially perpendicular to the longitudinal axis 130.

The collar top end portion 122 may include a collar first taper 150 that adjoins the collar inner surface 138 at a collar first taper start 152, and adjoins the collar top end tip 126 at a collar first taper end 154. As shown, the collar first taper 150 may define a substantially conical surface at an angle A with respect to the longitudinal axis 130 such that a collar inner diameter measured at the collar first taper start 152 is less than a collar inner diameter measured at the collar first taper end 154. Angle A may be between approximately 10° and approximately 70°, between approximately 20° and approximately 60°, between approximately 30° and approximately 50°, or between approximately 35° and approximately 45°. In some embodiments, angle A may be approximately 40°.

The collar bottom end portion 124 may include a second slope 156 of the collar outer surface 136. As shown, the second slope 156 may be defined by an angle φ with respect to the longitudinal axis 130 extending from a start point 158 to an end point 160 along a length of the collar outer surface 136. The magnitude of angle φ may be 60° or less, 50° or less, 40° or less, 30° or less, 20° or less, 10° or less, or between 0° and 5°. Alternatively, the second slope 156 may be defined by a sequence of two or more angles with respect to the longitudinal axis 130 extending from the start point 158 to the end point 160 along a length of the collar outer surface 136. As a further alternative, or as an additional aspect, the second slope 156 may be defined by a curvature of the collar outer surface 136 with respect to the longitudinal axis 130 extending from the start point 158 to the end point 160 along a length of the collar outer surface 136. The start point 158 of the second slope 156 may be located at a distance S2 from the central radial axis 134, and the end point 160 of the second slope 156 may be located at a distance E2 from the central radial axis 134, such that distance E2 is greater than distance S2. Additionally, a collar outer diameter at the start point 158 of the second slope 156 may be greater than a collar outer diameter at the end point 160 of the second slope 156. In some embodiments, the collar outer surface 136 may include one or more circumferential groove(s) 146 at and/or proximate to the start of the second slope 156. The end point 160 of the second slope 156 may be proximate to the collar bottom end tip 128, and/or the end point 160 of the second slope 156 may adjoin or may be coincident with the collar bottom end tip 128. The collar bottom end tip 128 may be angled with respect to the longitudinal axis 130. Alternatively, or additionally, the collar bottom end tip 128 may be at least partially rounded. Furthermore, the collar bottom end tip 128 may define at least in part a rounded profile such that the second slope 156 adjoins the collar bottom end tip 128 tangentially to the rounded profile at the end point 160 of the second slope 156. In some embodiments, the collar bottom end tip 128 may have a surface adjoining a rounded profile, which surface may be substantially perpendicular to the longitudinal axis 130.

The collar bottom end portion 124 may include a collar second taper 166 that adjoins the collar inner surface 138 at a collar second taper start 168, and adjoins the collar bottom end tip 128 at a collar second taper end 170. As shown, the collar second taper 166 may be define a substantially conical surface at an angle C with respect to the longitudinal axis 130 such that a collar inner diameter measured at the collar second taper start 168 is less than a collar inner diameter measured at the collar second taper end 170. Angle C may be between approximately 10° and approximately 70°, between approximately 20° and approximately 60°, between approximately 30° and approximately 50°, or between approximately 35° and approximately 45°. In some embodiments, angle C may be approximately 40°.

The stop collar assembly 100 may include a first slip 118. The first slip 118 may be configured as a ring member, and thus may encircle the tubular 112 when the first slip 118 is mounted onto the tubular 112. The first slip 118 may have an internal diameter that is greater than an outer diameter of the tubular 112 so as to facilitate the mounting of the first slip 118 around the tubular 112. Although the first slip 118 may be configured as a continuous ring member, in some embodiments the first slip 118 may be configured as a C-ring having a gap 172 (see FIGS. 7A and 7B) at a location around its circumference. The first slip 118 has a length LS1 measured in a dimension parallel to the longitudinal axis 130.

The first slip 118 may have a first slip top end 174, a first slip bottom end 176, and a first slip inner surface 178 adjoining the first slip top end 174 and the first slip bottom end 176. The first slip inner surface 178 may include a grip formation 180 configured to bear against an outer surface 114 of the tubular 112. The grip formation 180 may be configured to penetrate into the outer surface 114 of the tubular 112, and may comprise one or more tooth/teeth 182 and/or a coating comprising angular particles of a material, such as tungsten carbide, whose hardness is greater than that of the tubular 112. Alternatively, or additionally, the grip formation 180 may be configured to provide a friction grip on the outer surface 114 of the tubular 112, and may comprise any one or more of a ridge, lump, treatment, and/or coating that provides an area of roughness on the first slip inner surface 178.

The first slip 118 may have a first slip outer surface 184 adjoining the first slip top end 174. In some embodiments, the first slip outer surface 184 adjoins a first slip taper 186 that may terminate at or proximate to the first slip bottom end 176. Thus, the first slip taper 186 may adjoin the first slip bottom end 176. As shown, the first slip taper 186 may define a substantially conical surface at an angle B with respect to the longitudinal axis 130 such that a first slip outer diameter measured at the location 262 where the first slip taper 186 ends is less than a first slip outer diameter measured at the location 260 where the first slip taper 186 starts. Angle B may be between approximately 10° and approximately 70°, between approximately 20° and approximately 60°, between approximately 30° and approximately 50°, or between approximately 35° and approximately 45°. In some embodiments, angle B may be approximately 40°.

The stop collar assembly 100 may include a second slip 120. The second slip 120 may be configured as a ring member, and thus may encircle the tubular 112 when the second slip 120 is mounted onto the tubular 112. The second slip 120 may have an internal diameter that is greater than an outer diameter of the tubular 112 so as to facilitate the mounting of the second slip 120 around the tubular 112. Although the second slip 120 may be configured as a continuous ring member, in some embodiments the second slip 120 may be configured as a C-ring having a gap 172 (see FIGS. 7A and 7B) at a location around its circumference. The second slip 120 has a length LS2 measured in a dimension parallel to the longitudinal axis 130.

The second slip 120 may have a second slip top end 188, a second slip bottom end 190, and a second slip inner surface 192 adjoining the second slip top end 188 and the second slip bottom end 190. The second slip inner surface 192 may include a grip formation 180, as per the above description for the first slip 118, configured to bear against an outer surface 114 of the tubular 112.

The second slip 120 may have a second slip outer surface 194 adjoining the second slip bottom end 190. The second slip outer surface 194 may adjoin a second slip taper 196 that may terminate at or proximate to the second slip top end 188. Thus, the second slip taper 196 may adjoin the second slip top end 188. As shown, the second slip taper 196 may define a substantially conical surface at an angle D with respect to the longitudinal axis 130 such that a second slip outer diameter measured at the location 266 where the second slip taper 196 ends is less than a second slip outer diameter measured at the location 264 where the second slip taper 196 starts. Angle D may be between approximately 10° and approximately 70°, between approximately 20° and approximately 60°, between approximately 30° and approximately 50°, or between approximately 35° and approximately 45°. In some embodiments, angle D may be approximately 40°.

The collar first taper 150 may be configured to contact and interact with the first slip taper 186, and the collar second taper 166 may be configured to contact and interact with the second slip taper 196. When the stop collar assembly 100 is secured in place around the tubular 112, at least a portion of the collar first taper 150 may contact at least a portion of the first slip taper 186, and at least a portion of the collar second taper 166 may contact at least a portion of the second slip taper 196. Furthermore, a distance SE1 from the central radial axis 134 to the first slip bottom end 176 may be less than distance E1, but may be greater than distance S1. Similarly, a distance SE2 from the central radial axis 134 to the second slip top end 188 may be less than distance E2, but may be greater than distance S2.

Additionally, or alternatively, when the stop collar assembly 100 is secured in place around the tubular 112, a distance CT1 from the central radial axis 134 to the collar first taper start 152 may be greater than the distance SE1 from the central radial axis 134 to the first slip bottom end 176. Additionally, or alternatively, when the stop collar assembly 100 is secured in place around the tubular 112, a distance CT10 from the central radial axis 134 to the collar first taper end 154 may be greater than the distance CT1 from the central radial axis 134 to the collar first taper start 152. Additionally, or alternatively, when the stop collar assembly 100 is secured in place around the tubular 112, a distance ST1 from the central radial axis 134 to the first slip taper start 260 may be greater than the distance CT10 from the central radial axis 134 to the collar first taper end 154. Additionally, or alternatively, when the stop collar assembly 100 is secured in place around the tubular 112, the distance ST1 from the central radial axis 134 to the first slip taper start 260 may be greater than a distance CE1 from the central radial axis 134 to the collar top end tip 126.

Additionally, or alternatively, when the stop collar assembly 100 is secured in place around the tubular 112, a distance CT2 from the central radial axis 134 to the collar second taper start 168 is greater than the distance SE2 from the central radial axis 134 to the second slip top end 188. Additionally, or alternatively, when the stop collar assembly 100 is secured in place around the tubular 112, a distance CT20 from the central radial axis 134 to the collar second taper end 170 is greater than the distance CT2 from the central radial axis 134 to the collar second taper start 168. Additionally, or alternatively, when the stop collar assembly 100 is secured in place around the tubular 112, a distance ST2 from the central radial axis 134 to the second slip taper start 264 is greater than the distance CT20 from the central radial axis 134 to the collar second taper end 170. Additionally, or alternatively, when the stop collar assembly 100 is secured in place around the tubular 112, the distance ST2 from the central radial axis 134 to the second slip taper start 264 is greater than a distance CE2 from the central radial axis 134 to the collar bottom end tip 128.

Additionally, or alternatively, when the stop collar assembly 100 is secured in place around the tubular 112, a majority of the first slip length LS1 protrudes from the collar top end portion 122 and a majority of the second slip length LS2 protrudes from the collar bottom end portion 124.

In the embodiment shown in FIGS. 2A to 2C, angle A may be substantially equal to angle B within the normal ranges of engineering and manufacturing tolerances. Similarly, angle C may be substantially equal to angle D within the normal ranges of engineering and manufacturing tolerances. In some embodiments, angle A may be substantially unequal to angle B, i.e. outside the normal ranges of engineering and manufacturing tolerances. For example, angle A may be nominally 39° and angle B may be nominally 40°. In some embodiments, the difference between angle A and angle B may be from 1° to 5°. In some embodiments, angle A may be less than angle B. In other embodiments, angle A may be greater than angle B. In some embodiments, angle C may be substantially unequal to angle D, i.e. outside the normal ranges of engineering and manufacturing tolerances. For example, angle C may be nominally 39° and angle D may be nominally 40°. In some embodiments, the difference between angle C and angle D may be from 1° to 5°. In some embodiments, angle C may be less than angle D. In other embodiments, angle C may be greater than angle D.

Furthermore, in some embodiments, the difference in magnitude between angles A and B is substantially the same as the difference in magnitude between angles C and D within the normal ranges of engineering and manufacturing tolerances. Alternatively, in other embodiments, the difference in magnitude between angles A and B is not substantially the same as the difference in magnitude between angles C and D. Still further, it is contemplated that a stop collar assembly 100 may have angle A greater than, substantially equal to, or less than angle B, and may have angle C greater than, substantially equal to, or less than angle D. Additionally, the above options are contemplated to pertain to embodiments before the stop collar assembly 100 is secured to a tubular 112 and/or during the act of securing the stop collar assembly 100 to a tubular 112 and/or after the stop collar assembly 100 has been secured to a tubular 112.

The installation of the stop collar assembly 100 may involve the stop collar assembly 100 being placed around a tubular 112 and moved relative to the tubular 112 to a desired location on the tubular 112. The stop collar assembly 100 may be positioned such that the first slip taper 186 is placed proximate to the collar first taper, and the second slip taper 196 is placed proximate to the collar second taper 166. The stop collar assembly 100 may then be secured in place by applying a substantially longitudinal force or forces that act upon the first slip 118 and/or the second slip 120 so as to reduce a distance between the first slip bottom end 176 and the second slip top end 188. The substantially longitudinal force or forces may be applied by a setting tool that contacts one or both of the first slip 118 and the second slip 120. The setting tool may contact one or both of the first slip top end 174 and the second slip bottom end 190. The setting tool may be configured similarly to setting tools disclosed in U.S. Pat. Nos. 3,040,405 and/or 9,322,228; the disclosures of which are herein incorporated by reference.

The act of reducing a distance between the first slip bottom end 176 and the second slip top end 188 may cause the collar first taper 150 to interact with the first slip taper 186 such that the first slip bottom end 176 moves radially inward. Similarly, the act of reducing a distance between the first slip bottom end 176 and the second slip top end 188 may cause the collar second taper 166 to interact with the second slip taper 196 such that the second slip top end 188 moves radially inward. Such radial inward motion of the first slip bottom end 176 and/or second slip top end 188 may cause the grip formation(s) 180 of the first and/or second slip 118, 120 to bear against the outer surface 114 of the tubular 112. In embodiments in which the grip formation(s) 180 comprises one or more tooth/teeth 182, the one or more tooth/teeth 182 may at least partially penetrate into the outer surface 114 of the tubular 112. The actions of the grip formation(s) 180 bearing against the outer surface 114 of the tubular 112 may anchor the first slip 118 and/or second slip 120 to the tubular 112, which may anchor the stop collar assembly 100 to the tubular 112. Hence, the stop collar assembly 100 may become secured in position around the tubular 112.

The act of reducing a distance between the first slip bottom end 176 and the second slip top end 188 may cause the collar first taper 150 to interact with the first slip taper 186 such that the collar top end tip 126 moves radially outward away from the tubular 112 outer surface 114. Without being bound by any particular theory, it is thought that this action results in the collar 116 experiencing bending. This bending may be localized to a portion of the collar 116 including at least part of the collar top end portion 122. With the collar 116 experiencing this bending, an outer diameter of the collar 116 at the collar top end portion 122 may increase. The first slope 140 at the collar top end portion 122 may be dimensioned such that the outer diameter of the collar 116 at the collar top end portion 122 may increase without exceeding a maximum desired outer diameter of the stop collar assembly 100.

In some embodiments, the collar length LC may be selected to promote a localization of the bending to a certain portion of the collar 116. Additionally, or alternatively, the collar length LC may be selected to maintain stresses within the collar 116 associated with the bending within predetermined limits. Such limits may be determined through an analytical technique such as finite element analysis. The collar length LC may be equal to or greater than two inches. The collar length LC may be equal to or greater than three inches. The collar length LC may be equal to or greater than four inches. The collar length LC may be equal to or greater than five inches. In a preferred embodiment, the collar length LC may be greater than three inches, but less than or equal to five inches.

In some embodiments, the collar outer surface 136 may include a circumferential groove 146 at and/or proximate to the start of the first slope 140. Additionally, or alternatively, the collar inner surface 138 may include a circumferential groove 146 at an equivalent position, radially at and/or proximate to the start of the first slope 140. The circumferential groove(s) 146 may serve to provide a hinge. This hinge may be configured to enable any bending experienced by the collar 116 at the collar top end portion 122 to be localized to substantially the region of the collar top end portion 122. Alternatively, the collar length LC and/or the distance S1 and/or the distance E1 may be selected such that a hinge may not be necessary in order to localize the bending effect to substantially the region of the collar top end portion 122, and thus the circumferential groove(s) 146 and/or other features serving to provide the hinge may be omitted.

Similarly with respect to the foregoing disclosure, the act of reducing a distance between the first slip bottom end 176 and the second slip top end 188 may cause the collar second taper 166 to interact with the second slip taper 196 such that the collar bottom end tip 128 moves radially outward away from the outer surface 114 of the tubular 112. The second slope 156 at the collar bottom end portion 124 may be dimensioned such that the outer diameter of the collar 116 at the collar bottom end portion 124 may increase without exceeding a maximum desired outer diameter of the stop collar assembly 100.

Similarly with respect to the above, in some embodiments, the collar outer surface 136 may include a circumferential groove 146 at and/or proximate to the start of the second slope 156. Additionally, or alternatively, the collar inner surface 138 may include a circumferential groove 146 at an equivalent position, radially at and/or proximate to the start of the second slope 156. The circumferential groove(s) 146 may serve to provide a hinge. This hinge may be configured to enable any bending experienced by the collar 116 at the collar bottom end portion 124 to be localized to substantially the region of the collar bottom end portion 124. Alternatively, the collar length LC and/or the distance S2 and/or the distance E2 may be selected such that a hinge may not be necessary in order to localize the bending effect to substantially the region of the collar bottom end portion 124, and thus the circumferential groove(s) 146 and/or other features serving to provide the hinge may be omitted.

Figure 3A:
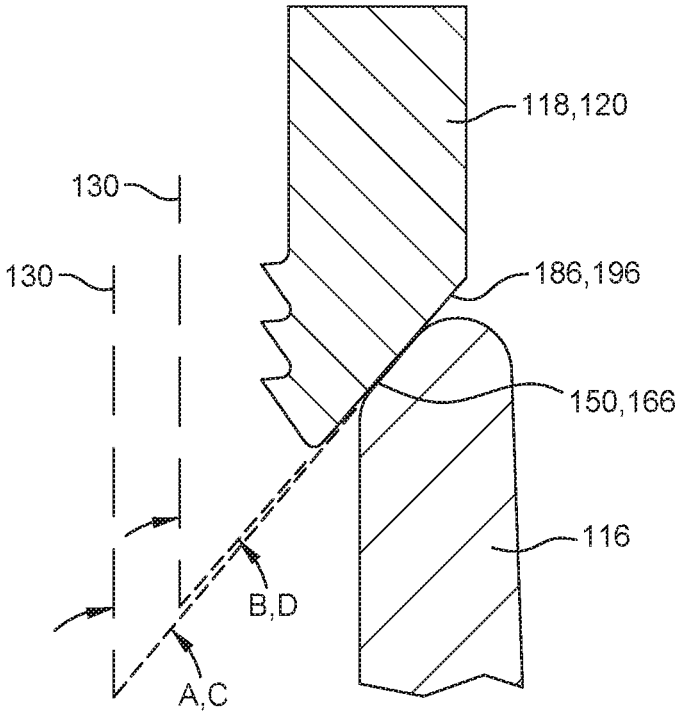
FIGS. 3A to 3C present longitudinal cross-sections showing parts of a stop collar assembly according to some embodiments of this disclosure.
Figure 3B:
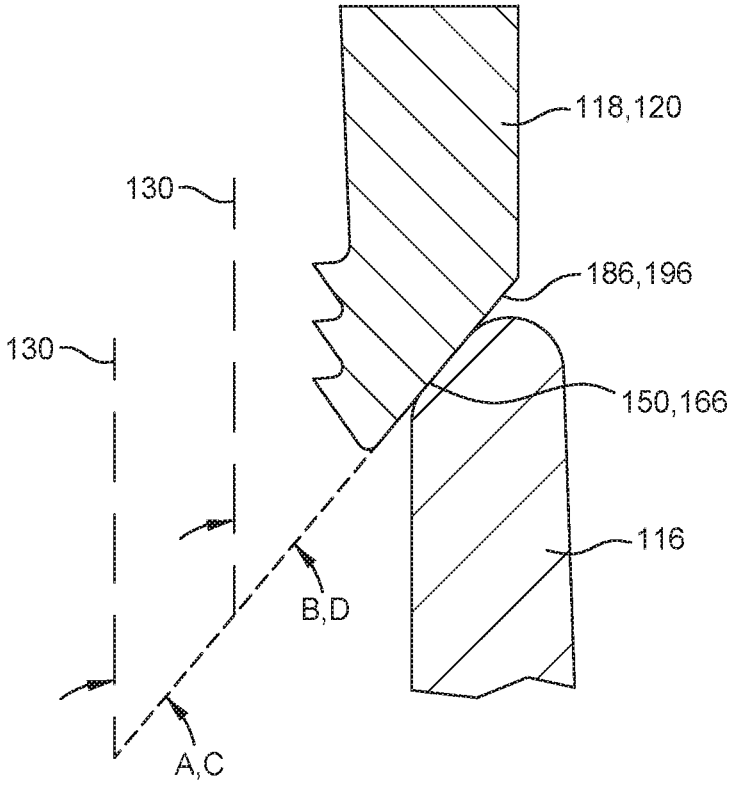
Figure 3C:
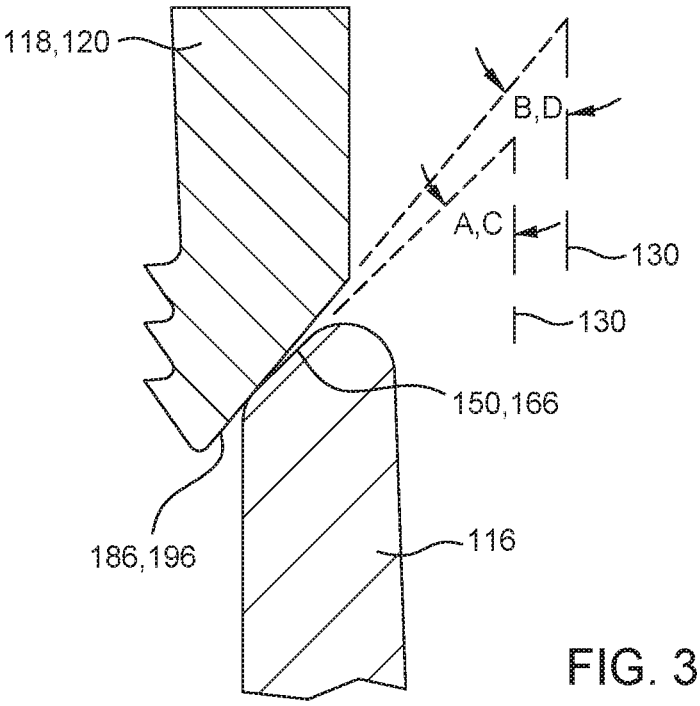

To the extent the collar top end portion 122 and/or the collar bottom end portion 124 experience outward bending as a result of the operation to secure the stop collar assembly 100 on a tubular 112, this may result in the magnitude of angle A and/or angle C changing during the securing process. By way of example, FIGS. 3A to 3C illustrate some of the options described above. FIG. 3A shows a close-up of one of the above optional variations before the stop collar assembly 100 is secured to a tubular 112. In this example, the magnitude of angle A (or angle C) is depicted as being less than the magnitude of angle B (or angle D). Thus an interface between the collar first taper 150 and the first slip taper 186 (or collar second taper 166 and the second slip taper 196) is substantially a circumferential line contact. FIG. 3B illustrates the example of FIG. 3A at an instant during and/or upon completion of the act of securing the stop collar assembly 100 to the tubular 112. In this depiction, the magnitude of angle A (or angle C) is shown to be substantially equal to the magnitude of angle B (or angle D). Thus an interface between the collar first taper 150 and the first slip taper 186 (or collar second taper 166 and the second slip taper 196) is substantially a planar contact. In an alternative embodiment, consistent with at least one of the options described above, FIG. 3B may represent a configuration before the stop collar assembly 100 is secured to a tubular 112. FIG. 3C illustrates the example of FIG. 3A and/or FIG. 3B at an instant during and/or upon completion of the act of securing the stop collar assembly 100 to the tubular 112. In this example, the magnitude of angle A (or angle C) is depicted as being greater than the magnitude of angle B (or angle D). Thus an interface between the collar first taper 150 and the first slip taper 186 (or collar second taper 166 and the second slip taper 196) is substantially a circumferential line contact.

Figure 4:
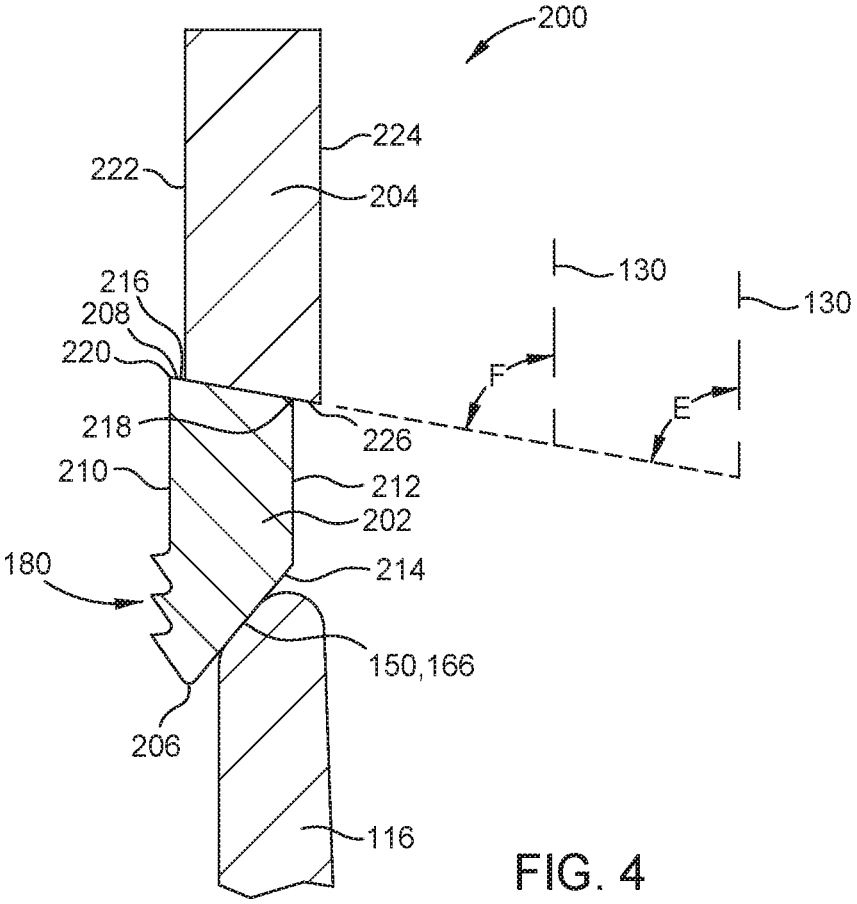
FIG. 4 is a longitudinal cross-section showing part of a stop collar assembly according to some embodiments of this disclosure.

In some embodiments, either or both the first slip 118 and the second slip 120 may comprise multiple pieces. FIG. 4 presents, in a longitudinal cross section, an example multi-piece slip 200, illustrated features of which may be incorporated into either or both the first slip 118 and second slip 120.

The multi-piece slip 200 may comprise a slip ring 202 and an abutment ring 204. The slip ring 202 may be configured to encircle a tubular 112 when the slip ring 202 is mounted onto the tubular 112. The slip ring 202 may have an internal diameter that is greater than an outer diameter of the tubular 112 so as to facilitate the mounting of the slip ring 202 around the tubular 112. Although the slip ring 202 may be configured as a continuous ring member, in some embodiments the slip ring 202 may be configured as a C-ring having a gap 172 (see FIGS. 7A and 7B) at a location around its circumference.

The slip ring 202 may have a slip ring first end 206, a slip ring second end 208, and a slip ring inner surface 210 adjoining the slip ring first end 206 and the slip ring second end 208. The slip ring inner surface 210 may include a grip formation 180, as per the above description for first slip 118 and second slip 120, configured to bear against an outer surface 114 of a tubular 112. The slip ring 202 may have a slip ring outer surface 212 adjoining a slip ring taper 214 that may terminate at or proximate to the slip ring first end 206. The slip ring taper 214 may be configured to contact and interact with either or both of the collar first taper 150 and the collar second taper 166. Hence, the slip ring taper 214 may define a substantially conical surface at an angle B or D with respect to the longitudinal axis 130, as described above for first slip 118 and second slip 120.

The slip ring outer surface 212 may also adjoin a slip ring face 216 at a slip ring face start 218 that may also adjoin the slip ring second end 208 at a slip ring face end 220. In some embodiments, the slip ring face 216 defines a substantially conical surface at an angle E with respect to the longitudinal axis 130 such that a length of the slip ring 202 measured parallel to the longitudinal axis 130 from the slip ring first end 206 to the slip ring face start 218 is less than a length of the slip ring 202 measured parallel to the longitudinal axis 130 from the slip ring first end 206 to the slip ring face end 220. Angle E may be greater than or equal to 45°, greater than or equal to 50°, greater than or equal to 60°, greater than or equal to 70°, or greater than or equal to 80°.

The abutment ring 204 may be configured to encircle a tubular 112 when the slip ring 202 is mounted onto the tubular 112. The abutment ring 204 may have an internal diameter that is greater than an outer diameter of the tubular 112 so as to facilitate the mounting of the abutment ring 204 around the tubular 112. The abutment ring 204 may be configured as a C-ring having a gap at a location around its circumference, however, in a preferred embodiment, the abutment ring 204 is configured as a continuous ring member. The abutment ring 204 may have an abutment ring inner surface 222 and an abutment ring outer surface 224. The abutment ring 204 may have an abutment ring face 226 that is configured to contact and interact with the slip ring face 216. Thus, the abutment ring face 226 may define a substantially conical surface at an angle F with respect to the longitudinal axis 130. In some embodiments, angle F may be substantially equal to angle E within the normal ranges of engineering and manufacturing tolerances. In some embodiments, an interface between the slip ring face 216 and the abutment ring face 226 is substantially a planar contact.

The securement of a stop collar assembly 100 incorporating one or more multi-piece slip(s) 200 as depicted in FIG. 4 involves a similar process to that described above with respect to the embodiment of FIGS. 2A to 2C. Here, the substantially longitudinal force described above is applied on the abutment ring 204. The substantially longitudinal force may be applied in a direction substantially parallel to the longitudinal axis 130. The substantially longitudinal force may be applied such that the abutment ring face 226 contacts the slip ring face 216, and thereby transmits the substantially longitudinal force to the slip ring 202, urging the slip ring taper 214 into engagement with the collar 116. In some embodiments, the nature of the interaction between the abutment ring face 226 and the slip ring face 216 caused by angles E and F may counteract any tendency of the slip ring second end 208 to move radially outward away from the outer surface 114 of the tubular 112. Other details of the securement process are essentially similar to those described above with respect to the embodiment of FIGS. 2A to 2C. Once the stop collar assembly 100 incorporating the multi-piece slip 200 of FIG. 4 has been secured to the tubular 112, the abutment ring 204 may be secured against further movement with respect to the tubular 112 by any suitable means, such as set screws, epoxy, an eccentric locking feature, etc.

Figure 5:
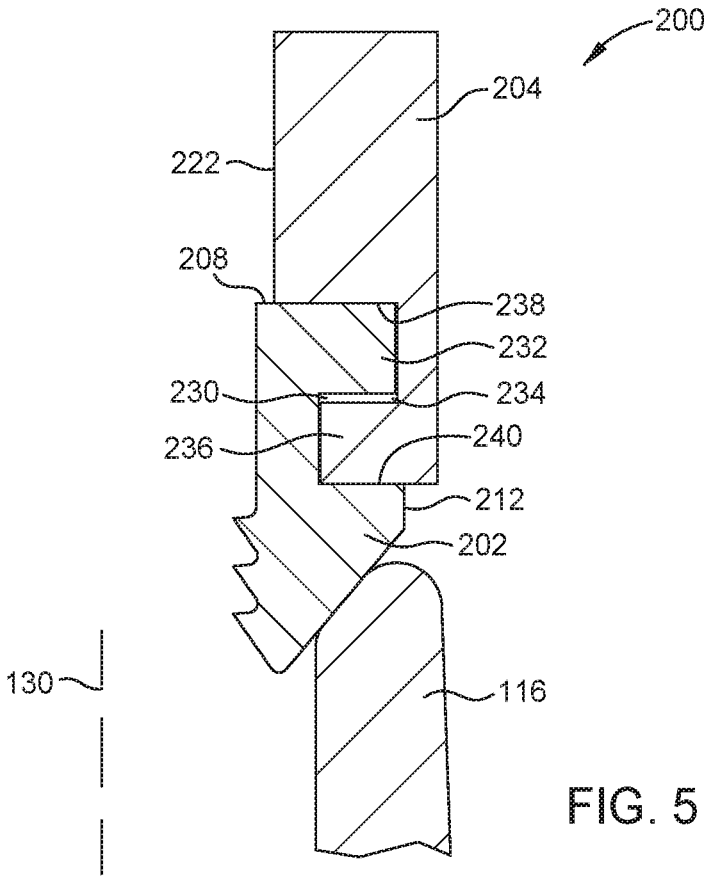
FIG. 5 is a longitudinal cross-section showing part of a stop collar assembly according to some embodiments of this disclosure.

FIG. 5 presents, in a longitudinal cross section, another example of a multi-piece slip 200. This example of a multi-piece slip 200 may comprise a slip ring 202 and an abutment ring 204 that are configured in similar fashion to those shown in FIG. 4, except for a modification as to how the slip ring 202 and the abutment ring 204 interface. Reference numbers common to FIGS. 4 and 5 have been used to represent features common between the embodiments. Illustrated features of the multi-piece slip 200 of FIG. 5 may be incorporated into either or both the first slip 118 and second slip 120.

Here, the slip ring outer surface 212 may include a slip ring groove 230 that is oriented substantially transverse to the longitudinal axis 130. The slip ring groove 230 may extend partially around the circumference of the slip ring 202. The slip ring 202 may have multiple such slip ring grooves 230 circumferentially aligned around the circumference of the slip ring 202. Alternatively, or additionally, the slip ring 202 may have a slip ring groove 230 that extends substantially fully around the circumference of the slip ring 202. The one or more slip ring groove(s) 230 may be positioned such that one or more slip ring tang(s) 232 project(s) radially outwardly between the slip ring groove(s) 230 and the slip ring second end 208.

The abutment ring inner surface 222 may include an abutment ring groove 234 that is oriented substantially transverse to the longitudinal axis 130. The abutment ring groove 234 may extend partially around the circumference of the abutment ring 204. The abutment ring 204 may have multiple such abutment ring grooves 234 circumferentially aligned around the circumference of the abutment ring 204. Alternatively, or additionally, the abutment ring 204 may have an abutment ring groove 234 that extends substantially fully around the circumference of the abutment ring 204. Each abutment ring groove 234 may be associated with one or more slip ring tang(s) 232 such that a slip ring tang 232 projects at least partially into an abutment ring groove 234. Similarly, the abutment ring 204 may have one or more abutment ring tang(s) 236 projecting radially inwardly, and each slip ring groove 230 may be associated with one or more abutment ring tang(s) 236 such that an abutment ring tang 236 projects at least partially into a slip ring groove 230.

The securement of a stop collar assembly 100 incorporating one or more multi-piece slip(s) 200 as depicted in FIG. 5 involves a similar process to that described above with respect to the embodiment of FIG. 4. A substantially longitudinal force may be applied to the abutment ring 204 in a manner similar to that described above. Here, a wall 238 of an abutment ring groove 234 may contact a slip ring tang 232, and thereby transmit the substantially longitudinal force to the slip ring 202, urging the slip ring taper 214 into engagement with the collar 116. Additionally, or alternatively, an abutment ring tang 236 may contact and transmit the substantially longitudinal force to a wall 240 of a slip ring groove 230, thereby urging the slip ring taper 214 into engagement with the collar 116. In some embodiments, one or more of the contacting surfaces of the slip ring 202 and the abutment ring 204 may define angles E and F, respectively, in a fashion and of a magnitude similar to the angles E and F, respectively, of FIG. 4. Thus, the nature of the interaction between the contacting surfaces of the slip ring 202 and the abutment ring 204 that is caused by angles E and F may counteract any tendency of the slip ring second end 208 to move radially outwardly away from the tubular 112 outer surface 114.

Additionally, once the stop collar assembly 100 incorporating the multi-piece slip 200 of FIG. 5 has been secured to the tubular 112, at least a portion of the abutment ring tang 236 may remain projecting into the slip ring groove 230. Furthermore, or alternatively, at least a portion of the slip ring tang 232 may remain projecting into the abutment ring groove 234. Such interactions may limit, or otherwise serve to contain, further longitudinal movement of the abutment ring 204 with respect to the tubular 112. Alternatively, or additionally, the abutment ring 204 may be secured against further movement with respect to the tubular 112 by any suitable means, such as set screws, epoxy, etc.

Figure 6:
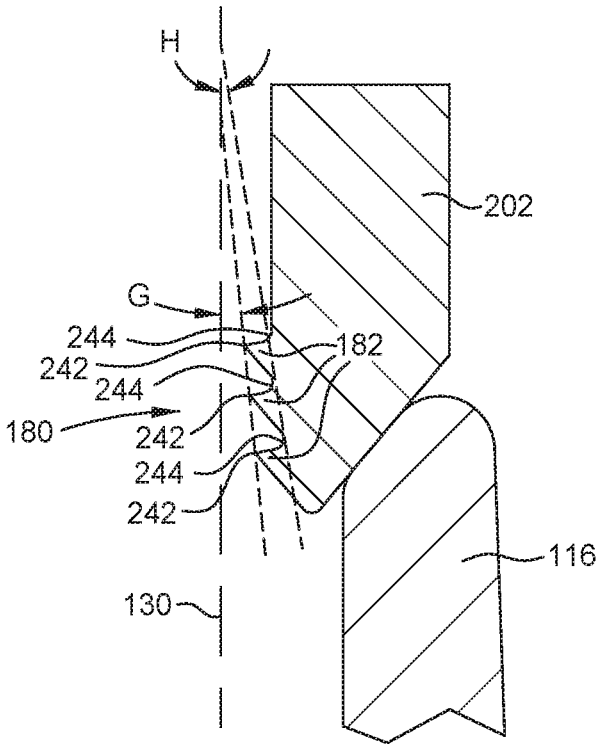
FIG. 6 is a longitudinal cross-section showing part of a stop collar assembly according to some embodiments of this disclosure.

FIG. 6 presents, in a longitudinal cross section, another example of a slip ring 202. Illustrated features of the slip ring 202 of FIG. 6 may be incorporated into either or both the first slip 118 and second slip 120. Reference numbers common to FIGS. 4, 5, and 6 have been used to represent features common between the embodiments. The slip ring 202 may be configured to encircle a tubular 112 when the slip ring 202 is mounted onto the tubular 112. The slip ring 202 may have an internal diameter that is greater than an outer diameter of the tubular 112 so as to facilitate the mounting of the slip ring 202 around the tubular 112. Although the slip ring 202 may be configured as a continuous ring member, in some embodiments the slip ring 202 may be configured as a C-ring having a gap 172 (see FIGS. 7A and 7B) at a location around its circumference.

The example slip ring 202 of FIG. 6 has a grip formation 180 comprising a series of teeth 182. The teeth 182 have crests 242 that may be configured to penetrate into the outer surface 114 of a tubular 112. The crests 242 may be aligned axially such that the alignment of the crests 242 describes an angle G with respect to the longitudinal axis 130. The teeth 182 may also have roots 244 between the crests 242. The roots 244 may be aligned axially such that the alignment of the roots 244 describes an angle H with respect to the longitudinal axis 130. Angle G may be less than or equal to 30 degrees, less than or equal to 20 degrees, less than or equal to 10 degrees, or less than or equal to 5 degrees. Although angle G may be 0 degrees, in a preferred embodiment, angle G is a value from 5 degrees to 10 degrees. Angle H may be less than or equal to 30 degrees, less than or equal to 20 degrees, less than or equal to 10 degrees, or less than or equal to 5 degrees. Although angle H may be 0 degrees, in a preferred embodiment, angle H is a value from 5 degrees to 10 degrees. In one embodiment, angle G is substantially equal to angle H. In one embodiment, angle G is not substantially equal to angle H. In one embodiment, angles G and H may be selected such that when a stop collar assembly 100 is secured in place, angle A of the collar first taper 150 substantially equals angle B of the first slip taper 186, and/or angle C of the collar second taper 166 substantially equals angle D of the second slip taper 196.

Figure 7A:
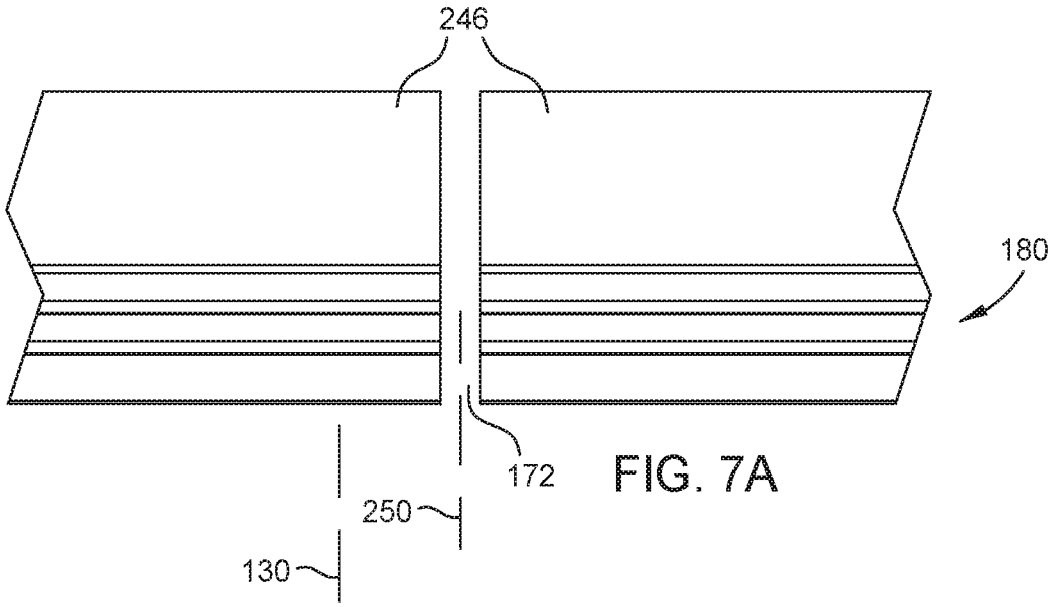
FIGS. 7A and 7B show alternative configurations of a slip that may be used with any of the stop collar assembly embodiments.
Figure 7B:
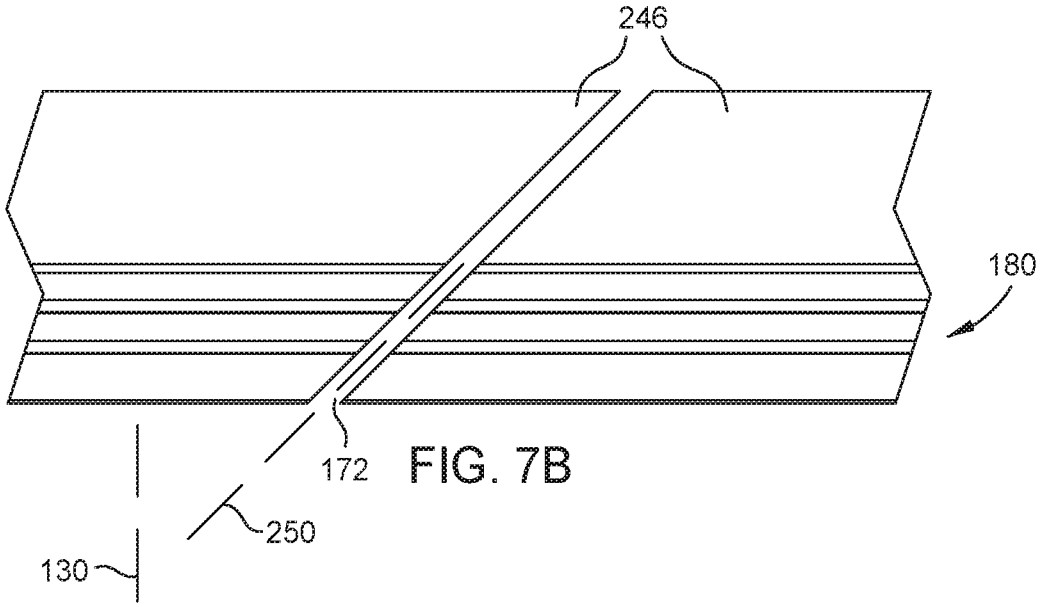

FIGS. 7A and 7B illustrate plan views of alternative C-ring configurations that may be used for any of the slips described above. In FIGS. 7A and 7B, slip 246 may be any of first slip 118, second slip 120, or any of the slip rings 202 depicted in FIGS. 4, 5, and 6. The slip 246 is shown in FIGS. 7A and 7B as having a gap 172 through the entire slip structure, and thus the slip 246 is a discontinuous ring. In FIG. 7A, the gap 172 has an axis 250 that is generally parallel to the longitudinal axis 130. In FIG. 7B, the gap 172 has an axis 250 that is generally not parallel to the longitudinal axis 130. During the securement of the stop collar assembly 100 on a tubular 112, the gap 172 may permit the necessary inward radial movement of the slip 246 to facilitate the slip 246 and/or any present formation to contact and grip the tubular 112.

While the foregoing is directed to embodiments of the present disclosure, other and further embodiments of the disclosure may be devised without departing from the basic scope thereof, and the scope thereof is determined by the claims that follow.

What is claimed is:

1. A stop collar assembly for mounting around a tubular, the stop collar assembly comprising:

a collar having a collar inner surface, a collar outer surface, a collar top end tip, a collar bottom end tip, a central radial axis, and a longitudinal axis, wherein:

the collar inner surface includes a collar first taper adjoining the collar top end tip, the collar outer surface includes a first slope defining a first slope angle with respect to the longitudinal axis, a collar outer diameter at a start of the first slope is greater than a collar outer diameter at an end of the first slope; and a first slip having a first slip bottom end and a first slip outer surface, the first slip outer surface including a first slip taper adjoining the first slip bottom end, the first slip taper configured to contact the collar first taper;

wherein when the collar first taper is in contact with the first slip taper:

a distance from the central radial axis to the start of the first slope is less than a distance from the central radial axis to the first slip bottom end; and the distance from the central radial axis to the first slip bottom end is less than a distance from the central radial axis to the end of the first slope.

2. The stop collar assembly of claim 1, further comprising a second slip having a second slip top end and a second slip outer surface, the second slip outer surface including a second slip taper adjoining the second slip top end;

wherein:

the collar outer surface includes a second slope defining a second slope angle with respect to the longitudinal axis;

a collar outer diameter at a start of the second slope is greater than a collar outer diameter at an end of the second slope;

the collar inner surface includes a collar second taper adjoining the collar bottom end tip; and the second slip taper is configured to contact the collar second taper.

3. The stop collar assembly of claim 2, wherein when the collar second taper is in contact with the second slip taper:

a distance from the central radial axis to the start of the second slope is less than a distance from the central radial axis to the second slip top end; and the distance from the central radial axis to the second slip top end is less than a distance from the central radial axis to the end of the second slope.

4. The stop collar assembly of claim 1, wherein when the stop collar assembly is secured in position around the tubular, a majority of a first slip length measured parallel to the longitudinal axis protrudes from the collar top end portion.

5. The stop collar assembly of claim 1, wherein an angle of the first slip taper with respect to the longitudinal axis is substantially equal to an angle of the collar first taper with respect to the longitudinal axis.

6. The stop collar assembly of claim 1, wherein the first slip comprises a first slip ring and a first abutment ring.

7. The stop collar assembly of claim 6, wherein a surface of the abutment ring contacts a surface of the slip ring.

8. The stop collar assembly of claim 7, wherein an interface between the surface of the abutment ring and the surface of the slip ring defines an angle with respect to the longitudinal axis.

9. The stop collar assembly of claim 6, wherein:

the slip ring includes a groove;

the abutment ring includes a tang; and the tang interfaces with the groove.

10. A stop collar assembly for mounting around a tubular, the stop collar assembly comprising:

a collar having a collar inner surface, a collar outer surface, a collar top end portion, a collar bottom end portion, and a longitudinal axis, wherein:

the collar top end portion includes a collar first taper adjoining the collar inner surface and adjoining a collar top end tip, the collar bottom end portion includes a collar second taper adjoining the collar inner surface and adjoining a collar bottom end tip;

a first slip having a first slip length measured parallel to the longitudinal axis, a first slip inner surface, and a first slip taper; and a second slip having a second slip length measured parallel to the longitudinal axis, a second slip inner surface, and a second slip taper;

wherein when the stop collar assembly is secured in position around the tubular:

at least a portion of the first slip inner surface is in gripping contact with the tubular;

at least a portion of the second slip inner surface is in gripping contact with the tubular;

at least a portion of the first slip taper abuts at least a portion of the collar first taper;

at least a portion of the second slip taper abuts at least a portion of the collar second taper;

a majority of the first slip length protrudes from the collar top end portion; and a majority of the second slip length protrudes from the collar bottom end portion.

11. The stop collar assembly of claim 10, wherein a maximum outer diameter of the first slip taper is greater than a maximum inner diameter of the collar first taper, and a maximum outer diameter of the second slip taper is greater than a maximum inner diameter of the collar second taper.

12. The stop collar assembly of claim 10, wherein the collar top end portion further comprises a top slope of the collar outer surface adjoining the collar top end tip.

13. The stop collar assembly of claim 10, wherein the collar bottom end portion further comprises a bottom slope of the collar outer surface adjoining the collar bottom end tip.

14. A stop collar assembly for a tubular, the stop collar assembly comprising:

a collar having a collar inner surface, a collar outer surface, a collar top end, a collar bottom end, and a longitudinal axis; and a first slip configured to be disposed at least partially within the collar and to be radially compressed by the collar, the first slip having a first slip inner surface, a first slip outer surface, a first slip top end, and a first slip bottom end;

wherein:

the first slip outer surface includes a first slip taper defined at an angle A with respect to the longitudinal axis and positioned proximate to the first slip bottom end;

the collar inner surface includes a collar first taper defined at an angle B with respect to the longitudinal axis and adjoining the collar top end;

the first slip taper is configured to interact with the collar first taper; and the angles A and B are not equal.

15. The stop collar assembly of claim 14, further comprising a second slip configured to be disposed at least partially within the collar and to be radially compressed by the collar, the second slip having a second slip inner surface, a second slip outer surface, a second slip top end, and a second slip bottom end.

16. The stop collar assembly of claim 15, wherein the second slip outer surface includes a second slip taper positioned proximate to the second slip top end, and the collar inner surface includes a collar second taper adjoining the collar bottom end.

17. The stop collar assembly of claim 16, wherein the second slip taper is configured to interact with the collar second taper.

18. The stop collar assembly of claim 17, wherein:

the second slip taper is defined at an angle C with respect to the longitudinal axis;

the collar second taper defined at an angle D with respect to the longitudinal axis; and the angles C and D are not equal.

19. The stop collar assembly of claim 18, wherein angle C is greater than angle D.

20. The stop collar assembly of claim 14, wherein angle A is greater than angle B.

* * * * *